US011072463B2

(12) United States Patent
Labedzki et al.

(10) Patent No.: US 11,072,463 B2
(45) Date of Patent: Jul. 27, 2021

(54) MODULAR CONTAINER ASSEMBLY

(71) Applicants: Agata Labedzki, Tinley Park, IL (US); Arkadiusz Labedzki, Tinley Park, IL (US)

(72) Inventors: Agata Labedzki, Tinley Park, IL (US); Arkadiusz Labedzki, Tinley Park, IL (US)

( * ) Notice: Subject to any disclaimer, the term of this patent is extended or adjusted under 35 U.S.C. 154(b) by 0 days.

(21) Appl. No.: 14/922,776

(22) Filed: Oct. 26, 2015

(65) Prior Publication Data

US 2017/0113836 A1 Apr. 27, 2017

(51) Int. Cl.
*B65D 21/08* (2006.01)
*B65D 8/00* (2006.01)

(52) U.S. Cl.
CPC ..... *B65D 21/083* (2013.01); *B65D 11/04* (2013.01)

(58) Field of Classification Search
CPC ..... B65D 21/0228; B65D 21/0234; B65D 21/083; B65D 41/26; B65D 51/249; B65D 41/04; A61J 9/008
See application file for complete search history.

(56) References Cited

U.S. PATENT DOCUMENTS 1,070,516 A * 8/1913 O'Brien ..... B65D 1/0223 215/11.1
2,326,414 A * 8/1943 Thompson ..... B65D 7/00 206/503
4,703,863 A * 11/1987 Kohus ..... A61J 9/00 215/11.1
5,431,290 A * 7/1995 Vinciguerra ..... A61J 9/04 137/845
5,570,797 A * 11/1996 Yeh ..... A47G 19/2272 215/228
5,829,607 A 11/1998 Ibrahim
D410,548 S 6/1999 Chomik
6,719,159 B2 4/2004 Chomik
7,658,294 B2 * 2/2010 Housley ..... A61J 11/04 215/12.1
8,191,844 B2 * 6/2012 Pennino ..... B62J 11/00 215/386
8,365,941 B2 2/2013 Mayer
8,703,052 B2 4/2014 Rohrig
2009/0266737 A1 10/2009 Cole
2011/0309083 A1 * 12/2011 Hsiu-Tzu Charlene ..... B65D 23/085 220/505
2013/0228544 A1 9/2013 Benetti

* cited by examiner

*Primary Examiner* — Andrew T Kirsch
(74) *Attorney, Agent, or Firm* — K&L Gates LLP

(57) ABSTRACT

A modular container assembly includes a housing having a bottom wall and a perimeter wall attached thereto and extending upwardly therefrom. The perimeter wall includes an open top end and a break therein positioned between the top end and the bottom wall to define an upper section and a lower section of the housing that are removably coupled together along the break. The lower section includes an upper edge defining an access. A lid is removably couplable to the bottom wall such that the lid is positioned exterior of the housing. The lid is engageable with the lower section to close the access. The perimeter wall can also include two breaks therein positioned near the open top end and bottom wall to define a top, middle, and bottom section of the housing. The middle section is removable, and the top section is engageable with the bottom section.

12 Claims, 8 Drawing Sheets

MODULAR CONTAINER ASSEMBLY

BACKGROUND OF THE DISCLOSURE

Field of the Disclosure

The disclosure relates to container devices and more particularly pertains to a new container device for allowing access to the bottom of a container while providing for a covering for such.

SUMMARY OF THE DISCLOSURE

An embodiment of the disclosure meets the needs presented above by generally comprising a housing having a bottom wall and a perimeter wall attached thereto and extending upwardly therefrom. The perimeter wall includes an open top end. The perimeter wall has a break therein positioned between the top end and the bottom wall to define an upper section and a lower section of the housing. The upper and lower sections are removably coupled together along the break. The lower section includes an upper edge defining an access into the lower section. A lid is removably couplable to the bottom wall such that the lid is positioned exterior of the housing. The lid is engageable with the lower section to close the access.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
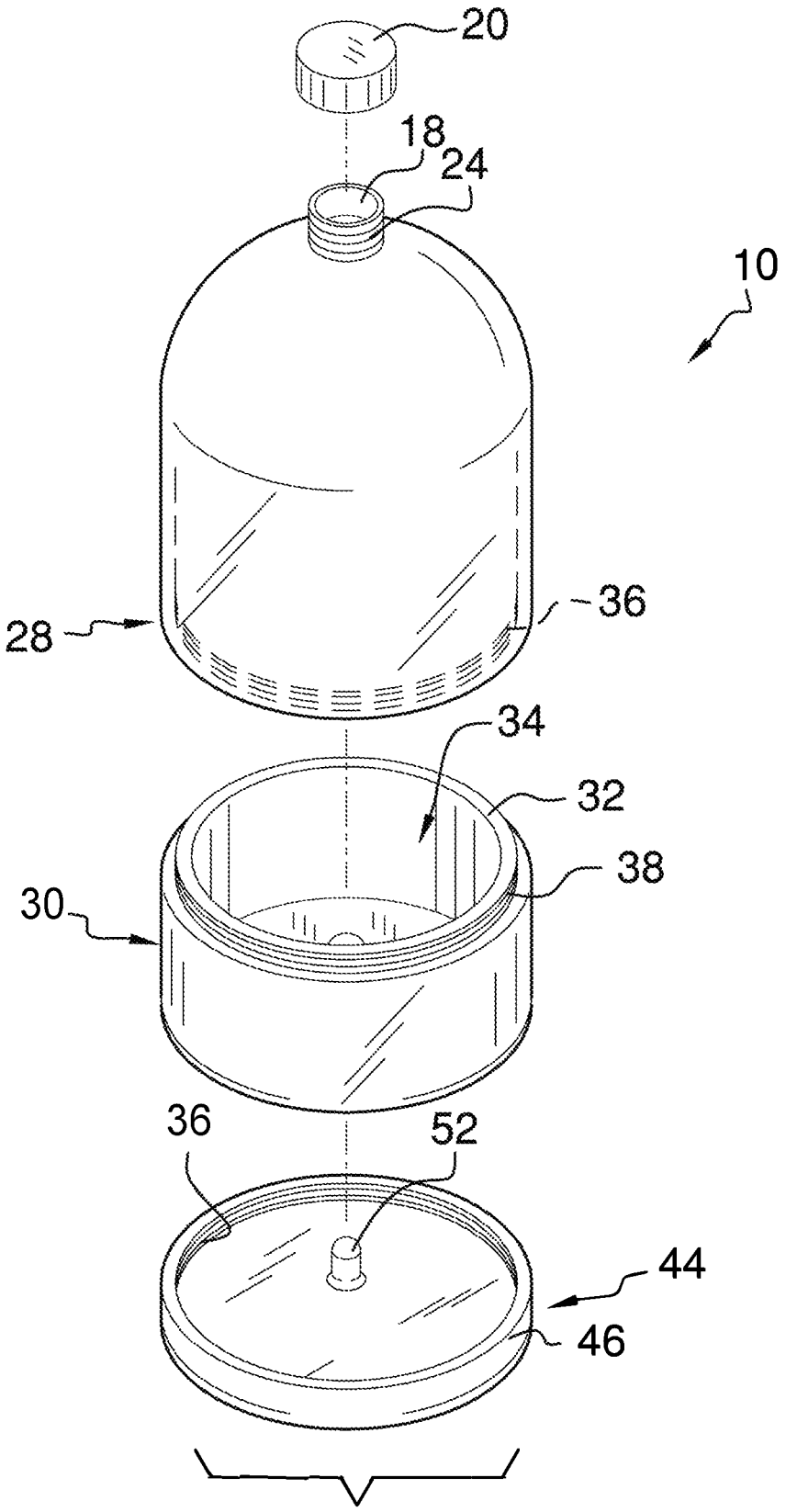
FIG. 1 is an exploded, front perspective view of a modular container assembly according to an embodiment of the disclosure.
Figure 2:
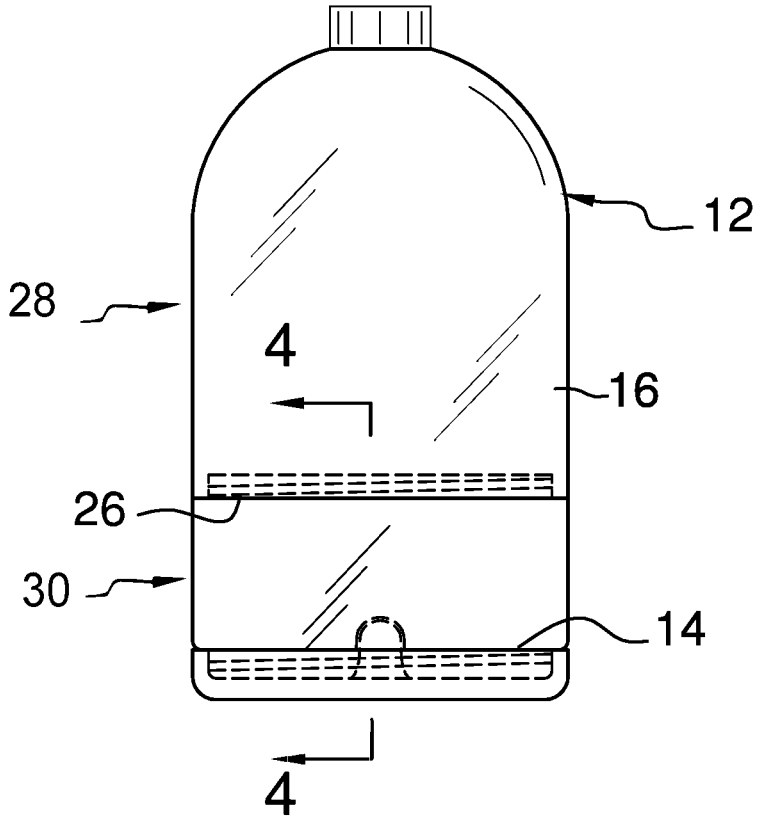
FIG. 2 is a front view of an embodiment of the disclosure.
Figure 3:
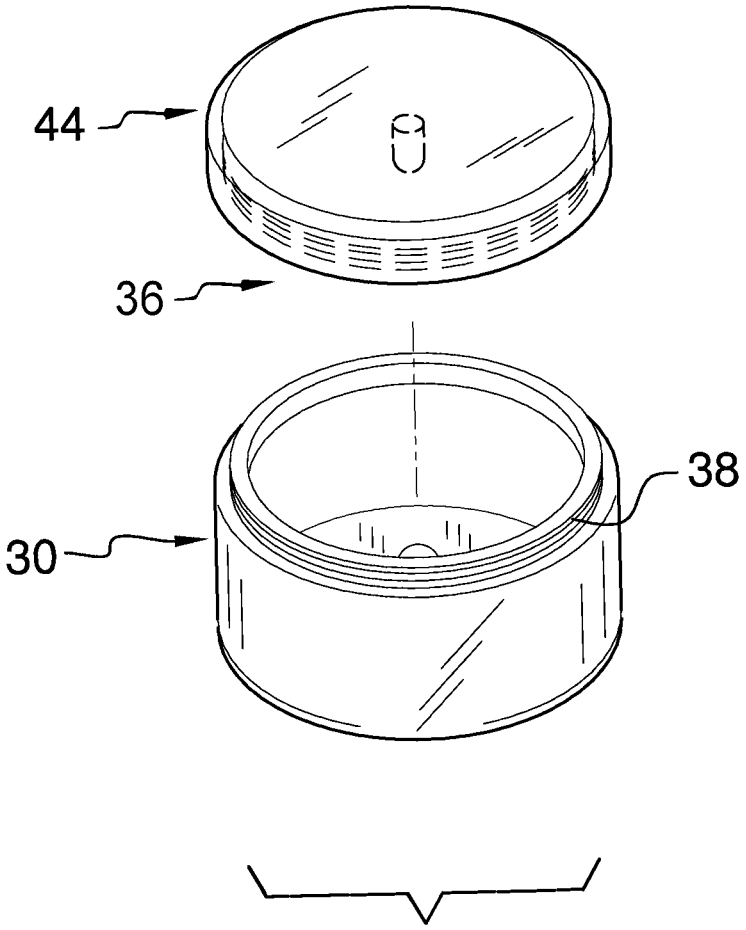
FIG. 3 is a rear perspective view of an embodiment of the disclosure.
Figure 4:
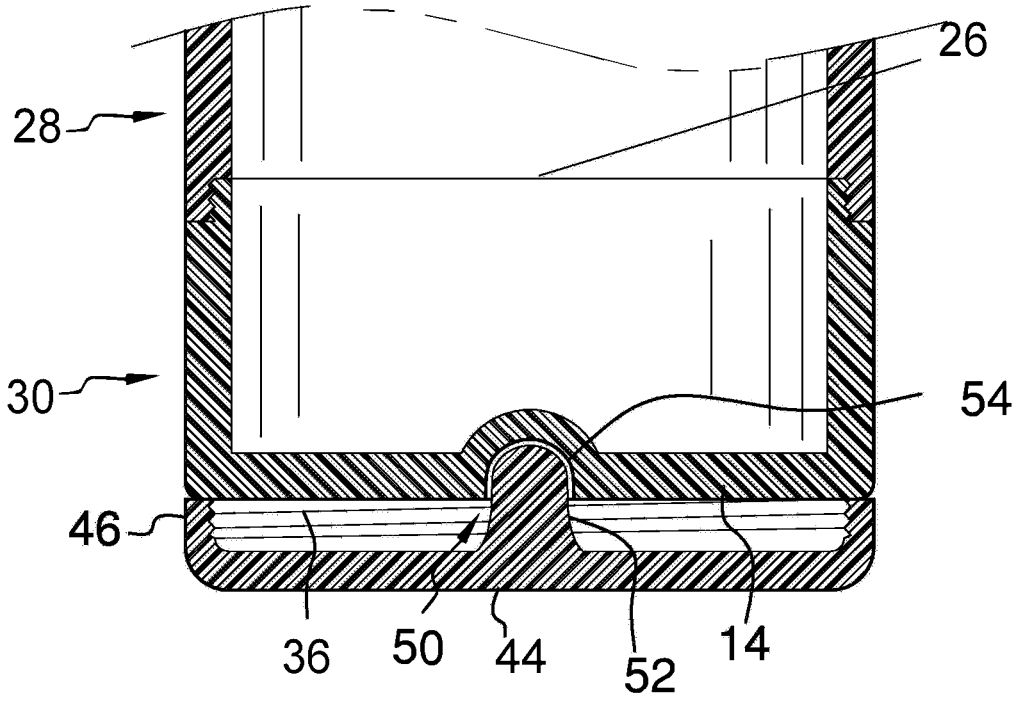
FIG. 4 is a cross-sectional view of an embodiment of the disclosure taken along line 4-4 of FIG. 2.

With reference now to the drawings, and in particular to FIGS. 1 through 8 thereof, a new container device embodying the principles and concepts of an embodiment of the disclosure and generally designated by the reference numeral 10 will be described.

As best illustrated in FIGS. 1 through 8, the modular container assembly 10 generally comprises a housing 12 that has a bottom wall 14 and a perimeter wall 16 that is attached thereto and extends upwardly therefrom. The perimeter wall 16 includes an open top end 18 and may be closed with a conventional cover 20 positioned on the open top end 18. The open top end 18 may include an ejector means for removing material from the housing 12 and which will also function as the cover 20. Though the Figures indicate such ejector means may include a spray nozzle 22, it should be understood that the spray nozzle 22 may instead comprise a pump, valve and other like structures conventionally used with multiple types of food and personal use product containers. The perimeter wall 16 has a break 26 therein positioned between the open top end 18 and bottom wall 14 to define an upper section 28 and a lower section 30 of the housing 12. The break 26 will typically be positioned nearer to the bottom wall 14 than the open top end 18 in such a manner to allow access 34 to the remaining content in the lower section 30. The upper 28 and lower 30 sections are removably coupled together along the break 26. The lower section 30 may include an upper edge 32 defining an access 34 into the lower section 30. As can be seen in FIG. 1, the upper section 28 includes an inner surface that is threaded adjacent to the break to define primary interior threading 36. The lower section 30 includes an outer surface that is threaded to define exterior threading 38. The primary interior threading 36 is threadably engageable with the exterior threading 38.

Figure 5:
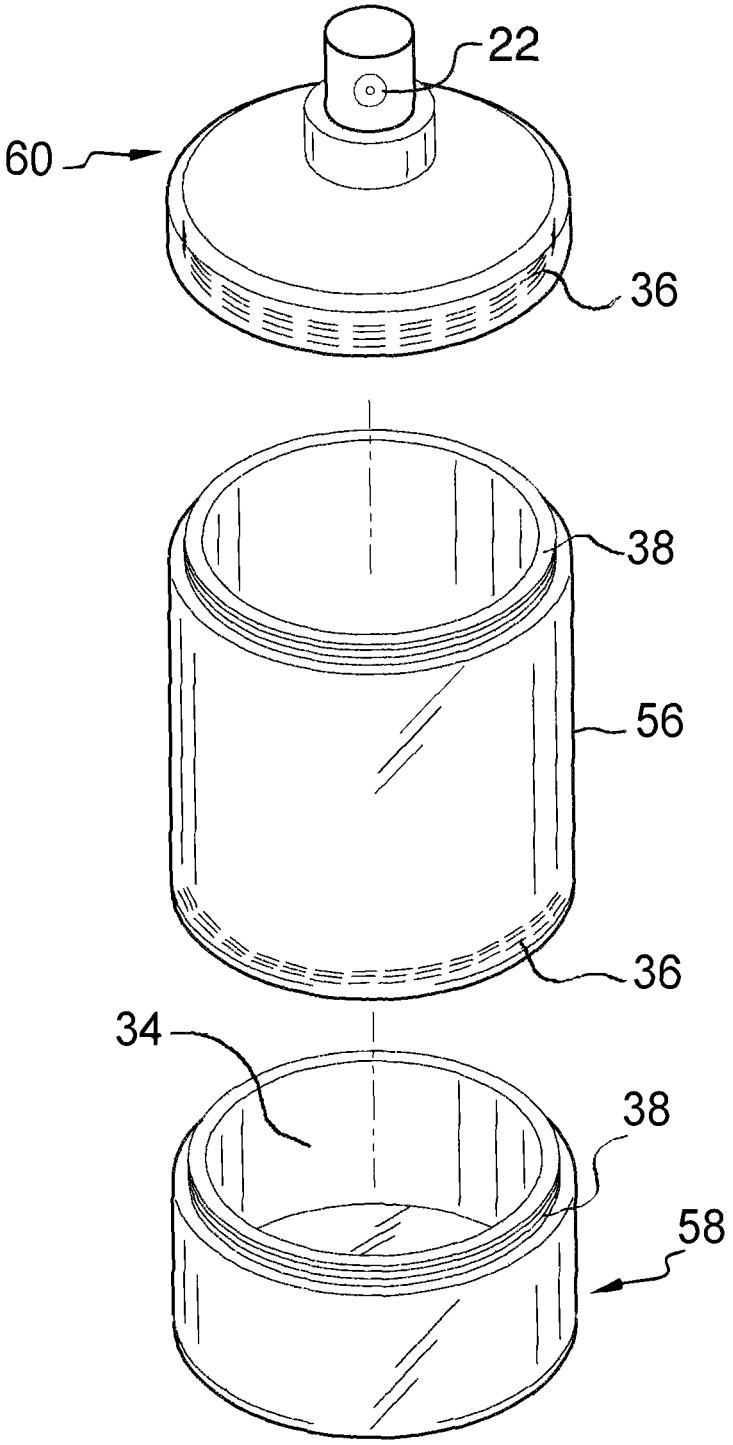
FIG. 5 is an exploded front perspective view of an embodiment of the disclosure.
Figure 6:
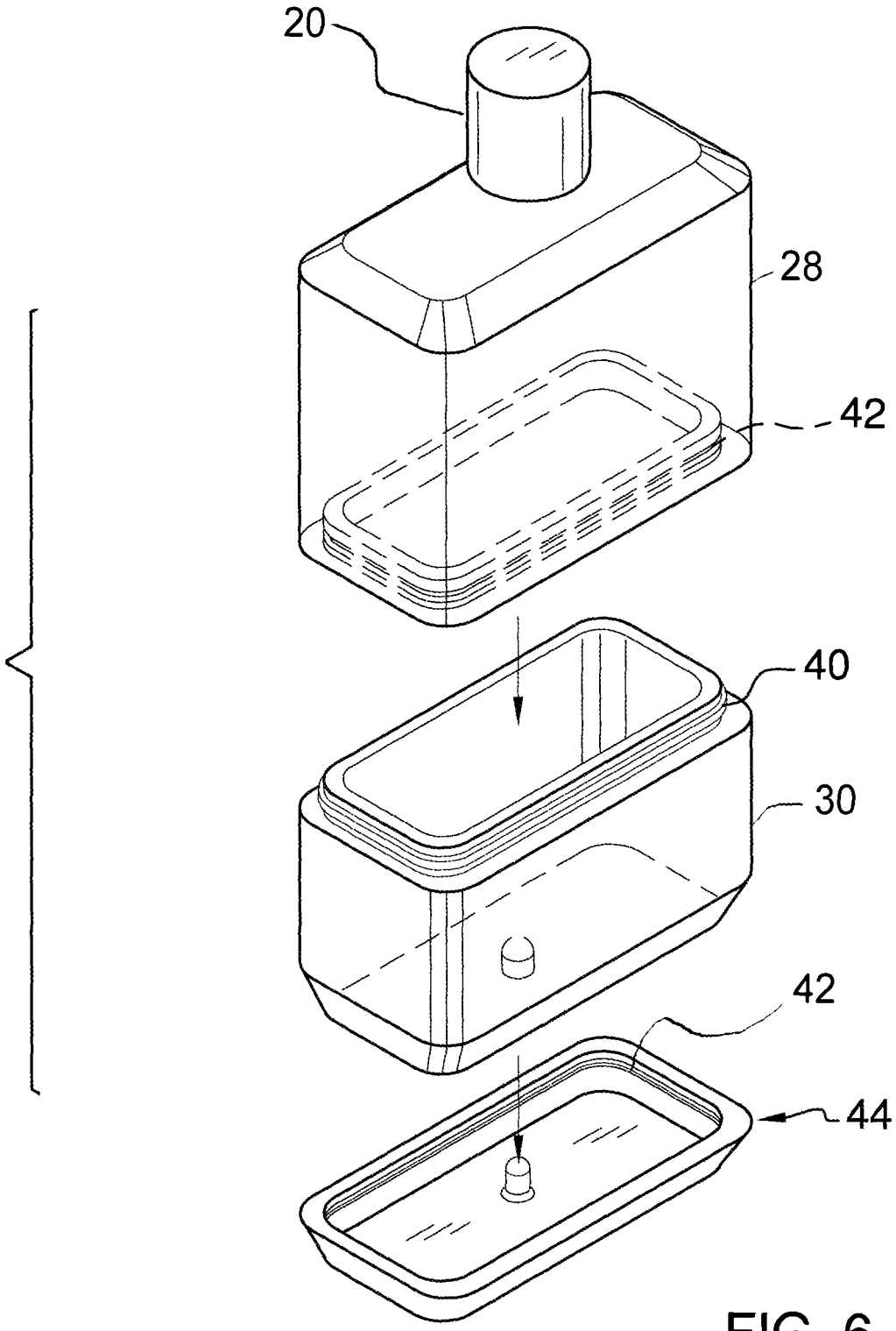
FIG. 6 is an exploded rear perspective view of an embodiment of the disclosure.
Figure 7:
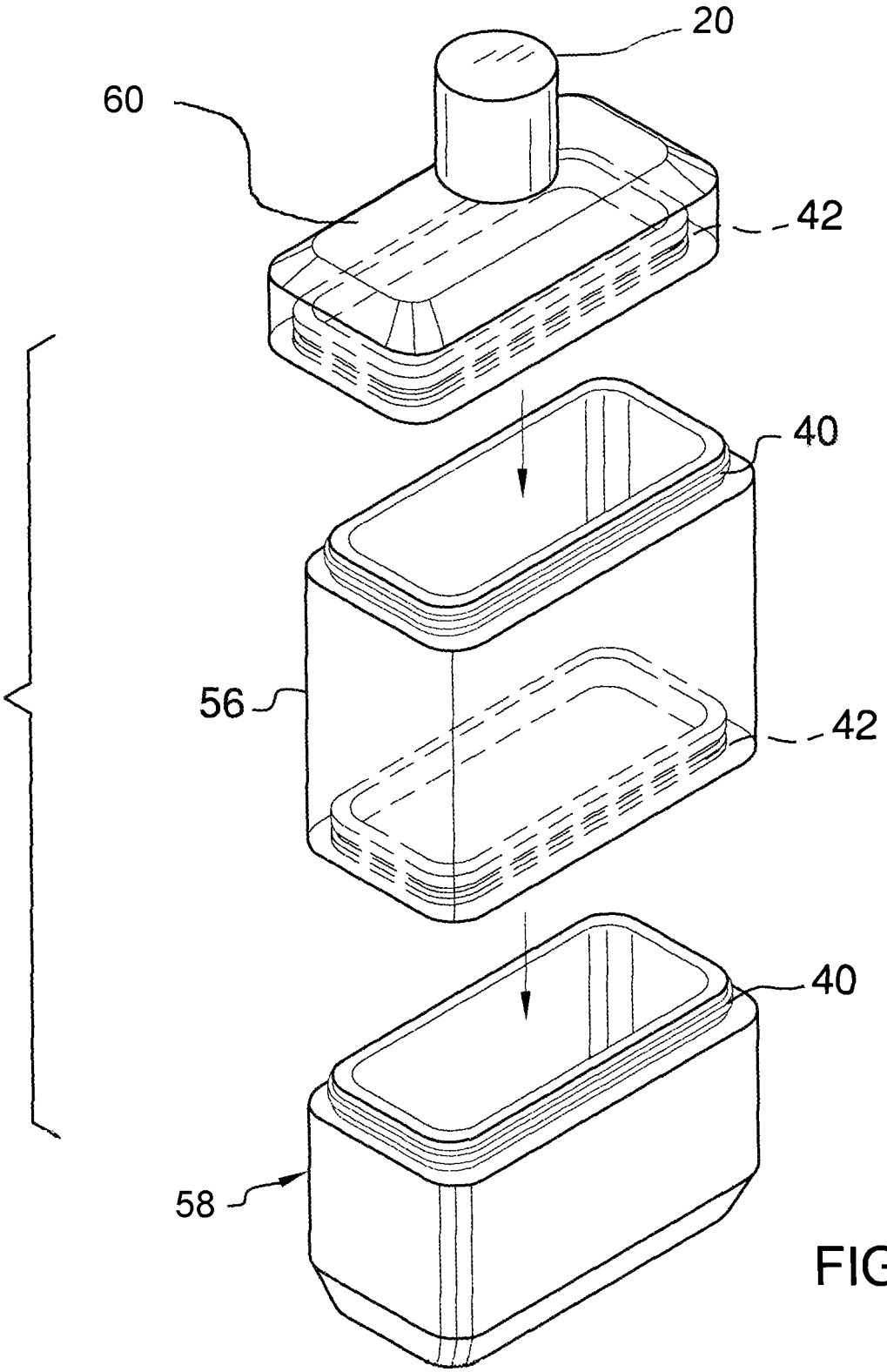
FIG. 7 is an exploded front perspective top view of an embodiment of the disclosure.
Figure 8:
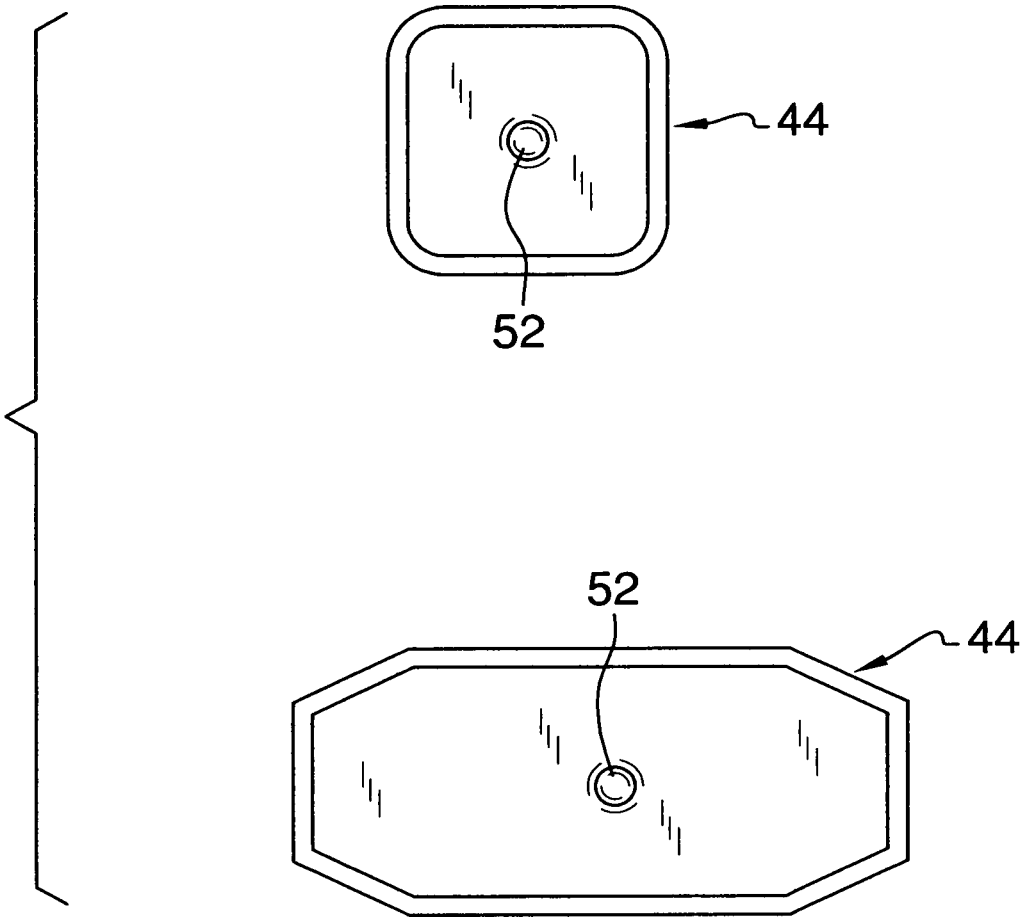
FIG. 8 is a top view of a pair of lids of different shapes of an embodiment of the disclosure.

If the perimeter wall 16 does not have a cylindrical shape at the break as shown in FIGS. 1-5 but instead includes shapes such as those shown in FIGS. 6-8, the joining of the upper 28 and lower 30 sections may be done by friction fit including a seal 40 in the lower section 30 that is engageable with a slot 42 positioned in the upper section 28. Thus depending on the shape of the housing 12, either a friction fit or a threaded coupler may be utilized.

A lid 44 is removably couplable to the bottom wall 14 such that the lid 44 is positioned exterior of the housing 12. This allows the lid 44 to be available when needed so that the lid 44 may be engageable with the lower section 30 to close the access 34. The lid 44 includes a flange 46 having an inner surface that is threaded to define secondary interior threading 36. The secondary interior threading 36 is threadably engageable with the exterior threading 38. However, as shown in FIG. 6, alternate means may be utilized for receiving the friction fit seal 40.

A coupler 50 releasably couples the lid 44 to the bottom wall 14. The coupler 50 includes a male member 52 that is attached to the lid 44 and a female member 54 extending upwardly into the bottom wall 14. The male member 52 is extendable into and frictionally engages the female member 54 to releasably attach the lid 44 to the bottom wall 14 without penetrating the bottom wall 14. The male member 52 is bounded by the flange 46.

Alternate embodiments shown FIGS. 5 and 7 depict no lid 44 but instead a middle section 56 of the perimeter wall 16 which is removable from between the bottom section 58 and the top section 60 of the housing 12. The top section 60 is threadably engageable by an interior threading 36 with the middle section exterior threading 38. Middle section 56 is threadably engageable by the interior threading 36 with exterior threading 38 of the bottom section 58. When said middle section 56 is removed, top section 60 is threadably engageable with the bottom section 58 to close said access 34.

In use, the user utilizes the housing 12 in a conventional manner until such time that the product within the housing is low and difficult to access. At that time, the upper 28 and lower 30 sections are removable from each other so that the lower section 30, now having a more shallow depth than said break 26 between the upper 28 and lower 30 sections, facilitates access to any product adjacent to the bottom wall 14. The lid 44 is thereafter used to close the access 34 to the upper edge of the lower section 30 to store the content without spillage or drying out.

In regard to the alternate embodiments, where no lid 44 is needed, the user removes the middle section 56 when needed to get to the shallow contents and engages top section 60 with the bottom section 58 threadably or by friction fit to close said access 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

INDEX OF ELEMENTS FOR MODULAR CONTAINER ASSEMBLY

10. modular container assembly
12. housing
14. bottom wall
16. perimeter wall
18. open top end
20. cover
22. nozzle
24. threaded opening
26. break
28. upper section
30. lower section
32. Upper edge
34. access opening
36. primary threading
38. exterior threading
40. Friction fit seal
42. slot
44. Lid
46. Flange
48. secondary threading
50. Coupler
52. male portion
54. female portion
56. middle section
58. Bottom section
60. Top section

We claim:

1. A modular container comprising:

a housing having:

a bottom wall and a perimeter wall being attached thereto and extending upwardly therefrom to define an interior, said perimeter wall including an open top end, said perimeter wall having a break therein positioned between said open top end and said bottom wall to define an upper section and a lower section of said housing, wherein said upper and lower sections are removably coupled together along said break and said interior of the housing being defined by the upper and lower sections combined, said lower section including an upper edge defining an access into said lower section, said lower section including said bottom wall; and a lid having a side wall extending between a planar surface and an end surface opposite the planar surface, wherein the side wall extends in a single upward direction from and terminates at the planar surface, wherein the lid includes an outer surface and an inner surface and is removably couplable to said bottom wall of the lower section such that said lid is positioned exterior of said housing without penetrating into the bottom wall of the housing, said lid being engageable with said upper edge of said lower section to close said access, wherein the inner surface includes internal threading, and wherein the outer surface is entirely smooth;

wherein, in a first position, the lid is secured to the bottom wall of the lower section of the housing through a friction fit; and wherein, in a second position, the lid is secured to the upper edge of the lower section and the internal threading engages with external threading along the upper edge of the lower modular unit;

wherein the lid is inverted when moving between the first and second positions such that the inner surface of the lid faces the housing in both of the first and second positions.

2. The modular container according to claim 1, wherein said upper section includes an inner surface being threaded adjacent to said break to define primary interior threading, said lower section including an outer surface being threaded to define exterior threading, said primary interior threading being threadably engageable with said exterior threading.

3. The modular container according to claim 1, further including a coupler located centrally on said planer surface of said lid that releasably couples said lid to said bottom wall without penetrating into said bottom wall when the lid is in the first position.

4. The modular container according to claim 3, wherein said coupler includes a male member formed on a planar surface of the lid, said male member being extendable into and frictionally engaging a female member extending upwardly from said bottom wall of the lower section to securely hold the lid in position on the bottom wall of the lower section along both lateral and vertical directions.

5. The modular container according to claim 1, said upper and lower sections including said lid, are engageable by either friction fit or threading, depending on said housing shape.

6. The modular container according to claim 1, wherein said break is nearer to said bottom wall than said open top end, said lower section is capable of holding content that can be closed by the lid attached to the bottom wall exterior of the housing in a manner that does not penetrate the housing bottom wall.

7. The modular container according to claim 1, wherein the end surface of the side wall of the lid abuts the bottom wall of the lower section of the housing when the lid is in the first position.

8. A modular container comprising:

a housing having:

a bottom wall and a perimeter wall being attached thereto and extending upwardly therefrom to define an interior, and wherein an outer surface of the perimeter wall is smooth;

said perimeter wall including an open top end, said perimeter wall having two breaks therein positioned near said open top end and near said bottom wall to define a top, middle, and bottom section of said housing;

said break near said open top end is positioned between said top and said middle section, said break near said bottom wall is positioned between said middle and said bottom section; and said interior of the housing being defined by the top, middle, and bottom sections combined;

wherein the perimeter wall has a consistent cross sectional area along a height from the bottom wall to the break positioned between said top and said middle section when said top, middle, and bottom sections are connected together to form the housing;

said top, middle, and bottom sections being removeable coupled together along said breaks, said bottom section including an upper edge and a base, wherein the upper edge at said break positioned between said middle and said bottom sections defines an access into said bottom section, wherein the bottom section includes an exterior threading at the upper edge;

wherein said middle section includes a lower edge at the break between the middle and bottom sections, wherein the middle section includes an internal threading and a smooth external surface at the lower edge, and wherein the internal threading at the lower edge of the middle section engages with the exterior threading at the upper edge of the bottom section;

said middle section is removable from between said top section and said bottom section, said top section is engageable with said bottom section to close access, wherein said bottom section is engageable with said top and middle sections at said upper edge.

9. The modular container according to claim 8, wherein said top section includes an inner surface being threaded adjacent to said break near said open top end to define interior threading, said middle section includes an outer surface being threaded at an upper edge to define exterior threading, said interior threading is engageable with said exterior threading, said middle section is removable from between said top and bottom sections, said top section is engageable with said bottom section through a threaded surface or a friction fit to close said access and to form the housing, and wherein an exterior surface of the perimeter wall on the bottom section and the base is smooth.

10. The modular container according to claim 8, said top, middle, and lower sections are engageable by either threading or friction fit, depending on said housing shape.

11. A modular container comprising:

a housing having:

a bottom wall and a perimeter wall being attached thereto and extending upwardly therefrom to define an interior, said perimeter wall including an open top end, said perimeter wall having a break therein positioned between said open top end and said bottom wall to define an upper section and a lower section of said housing, wherein said upper and lower sections are removably coupled together along said break and said interior of the housing being defined by the upper and lower sections combined, said lower section including an upper edge defining an access into said lower section, said lower section including said bottom wall, wherein said bottom wall includes a centrally located female member extending upwardly; and a lid including an outer surface and an inner surface being removably couplable to said bottom wall such that said lid is positioned exterior of said housing without penetrating into the bottom wall, said lid being engageable with said upper edge of said lower section to close said access, wherein the inner surface includes internal threading, wherein the outer surface is entirely smooth, and wherein the lid includes a centrally located male member protruding inwardly for engaging with the female member of the bottom wall of the lower section;

wherein, in a first position, the lid is secured to the bottom wall of the lower section of the housing through a friction fit, wherein the male member of the lid frictionally engages the female member to securely hold the lid in position on the bottom wall; and wherein, in a second position, the lid is secured to the upper edge of the lower section and the internal threading engages with external threading along the upper edge of the lower section;

wherein the lid is inverted when moving between the first and second positions such that the inner surface of the lid faces the housing in both of the first and second positions.

12. The modular container according to claim 11, wherein the end surface of the side wall of the lid abuts the bottom wall of the lower section of the housing when the lid is in the first position.

* * * * *